US008210405B1

(12) United States Patent
Pritchard

(10) Patent No.: US 8,210,405 B1
(45) Date of Patent: Jul. 3, 2012

(54) ADJUSTABLE LEATHER RIFLE SLING

(76) Inventor: Dennis Morgan Pritchard, Bristol, VA (US)

( * ) Notice: Subject to any disclaimer, the term of this patent is extended or adjusted under 35 U.S.C. 154(b) by 486 days.

(21) Appl. No.: 12/587,762

(22) Filed: Oct. 13, 2009

(51) Int. Cl.
*F41C 33/00* (2006.01)

(52) U.S. Cl. ..... 224/150; 224/913; 42/85

(58) Field of Classification Search ..... 224/150, 224/149, 913, 915–917, 922, 103; 24/2.5; 42/85

See application file for complete search history.

(56) References Cited

U.S. PATENT DOCUMENTS

| | | | | | |
|---|---|---|---|---|---|
| 1,323,701 | A | | 12/1919 | Lethern | |
| 1,945,932 | A | * | 2/1934 | Caley | 132/247 |
| 2,059,949 | A | | 11/1936 | Imler | |
| 2,480,129 | A | | 8/1949 | Gebler | |
| 3,182,871 | A | * | 5/1965 | Gossler | 224/149 |
| 3,334,794 | A | | 8/1967 | Saari et al. | |
| 3,365,753 | A | * | 1/1968 | Prenner et al. | 24/16 PB |
| 3,495,770 | A | | 2/1970 | Rolling et al. | |
| 3,653,564 | A | * | 4/1972 | Carter | 224/150 |
| 3,960,302 | A | * | 6/1976 | Mazzoni, Jr. | 294/147 |
| 4,098,441 | A | * | 7/1978 | Campbell | 224/150 |
| 4,114,838 | A | * | 9/1978 | Knauf | 294/157 |
| 4,311,263 | A | | 1/1982 | Bianchi | |
| 4,361,258 | A | | 11/1982 | Clark | |
| 4,401,246 | A | | 8/1983 | Dickenson et al. | |
| 4,511,070 | A | | 4/1985 | Hightower | |
| 4,760,944 | A | * | 8/1988 | Hughes | 224/609 |
| 4,817,835 | A | | 4/1989 | Tarr, Jr. | |
| 4,817,837 | A | * | 4/1989 | Grover | 224/250 |
| 4,942,644 | A | * | 7/1990 | Rowley | 24/16 PB |
| 5,082,155 | A | | 1/1992 | Salvador | |
| 5,282,558 | A | | 2/1994 | Martinez | |
| 5,433,360 | A | | 7/1995 | Rock | |
| D370,407 | S | * | 6/1996 | Pietrowski | D8/394 |
| 5,581,850 | A | * | 12/1996 | Acker | 24/16 PB |
| 5,660,309 | A | * | 8/1997 | Belanger et al. | 224/250 |
| 5,745,958 | A | * | 5/1998 | Kaldor | 24/16 R |
| 5,802,756 | A | | 9/1998 | Hightower | |
| 6,062,448 | A | * | 5/2000 | Balodis | 224/257 |
| 6,192,554 | B1 | * | 2/2001 | Dumcum | 24/16 PB |
| 6,843,393 | B2 | | 1/2005 | Sinclair | |
| 7,310,857 | B2 | * | 12/2007 | Kim | 24/17 A |
| D638,296 | S | * | 5/2011 | Levine | D9/455 |

* cited by examiner

*Primary Examiner* — Justin Larson
*Assistant Examiner* — Peter Helvey

(57) ABSTRACT

The invention is a versatile, but simple, rifle sling for carrying a rifle, shotgun, or other long gun over one shoulder. The sling can be attached to the rifle by use of studs or swivels in a conventional manner or can be attached directly to the firearm by using the adjustable loops at each end of the sling. It is constructed from a single strip of leather without the use of any hardware such as buckles, clasps, clamps, hooks, rivets, screws or other devices. Each of the adjustable loops are formed from slide-lock knots.

3 Claims, 23 Drawing Sheets

ADJUSTABLE LEATHER RIFLE SLING

BACKGROUND OF THE INVENTION

1. Field of Invention

The present invention relates to a gun sling for carrying a long gun such as a sporting rifle or shotgun. More specifically the invention is an adjustable leather rifle sling having adjustable loops at each end.

2. Description of the Prior Art

Of particular interest to many shooters is a rifle sling that is not only functional and user friendly, but is also aesthetically pleasing to the eye and made of natural materials such as leather. It is also desirable that the sling contain no components that could mar the finish on a firearm.

Another desirable feature of a rifle sling is that it can be quickly and easily adjusted for length to accommodate shooters of various sizes as well as different shooting positions.

A sling that provides support during the act of shooting that is simple, and easy to use, is preferred by many shooters over more complicated devices.

The vast majority of slings attache to the firearm by means of some sort of swivel device. While it is desirable to have a sling that utilizes these common devices, it is also desirable to be able to use the sling on firearms that do not have these devices such as antique arms, many older rifles, as well as most shotguns.

Many different kinds of slings are known and in common use. Some are simple while others are complicated. Some are used over one shoulder, others are used over both shoulders, still others go over the shooters neck, or around the body, some attache to a vest or other device. Some use a single strip of leather or other material while others use multiple strips. Most use some sort of adjustable loop for length adjustment, and this adjustment is made possible by the use of such hardware as buckles, clasps, clamps hooks, rivets, screws or other devices.

U.S. Pat. No. 4,817,835 issued to E. Tarr on Apr. 4, 1989 discloses a sling that can be used as a single shoulder sling or can be used over both shoulders. This sling uses a clasps and keeper for length adjustment. Some shooters will appreciate this sling while others would prefer a more simple design without the use of hardware.

U.S. Pat. No. 5,433,360 issued to T. Rock on Jul. 18, 1995 discloses a single shoulder sling that utilizes a slide and buckle for length adjustment.

U.S. Pat. No. 5,802,756 issued to F. Hightower on Sep. 8, 1998 discloses a sling that uses a support pad and thumb hole for over the shoulder carrying and fittings for length adjustment.

U.S. Pat. No. 6,843,393 issued to P. Sinclaire on Jan. 18, 2005 discloses a very nice, simple sling. It uses a minimum amount of hardware, namely a single Chicago screw. It is aesthetically pleasing and is simple to use. However, the slide-lock knot is formed from three somewhat long, narrow bands that have a tendency to stretch, thereby losing a portion of their holding power. Also no means of manually locking the knot is provided. Furthermore a fixed, rather than an adjustable, loop is provided at the opposite end of this sling.

None of the above inventions either singly or in combination is seen to describe the instant invention as claimed. Therefore an adjustable leather rifle sling solving the aforementioned problems is desired.

SUMMARY OF THE INVENTION

The foregoing shortcomings and disadvantages in prior art rifle slings are eliminated or substantially diminished in the present invention. Therefore a principle object of the present invention is to provide a rifle sling that is comprehensive, yet simple in design and manufacture, as well as simple in use by the shooter.

Accordingly, another object of the invention is that the rifle sling be constructed entirely from a single leather strap without the use of any type of hardware whatsoever such as buckles, clasps, clamps, hooks, rivets, screws, or other devices.

It is a further object of the invention that the sling be light weight and non-encumbering.

Another object of the invention is that the rifle sling be aesthetically pleasing in appearance, look unobtrusive and natural when attached to a firearm, and blend in with the typical shooting environment of field and forest.

It is an object of the invention to provide a sling that is completely adjustable in length so as to meet any requirement the shooter may have, and that these adjustments can be made in a simple, quick, and easy manner, and that these adjustments can be precise and positive.

It is a further object of the invention that the rifle sling be extremely quiet in use to avoid spooking the intended quarry.

It is an object of the invention to provide a rifle sling that can be attached to the firearm by use of typical stud and swivel or may be attached directly to the firearm without any auxiliary device.

It is also an object of the invention to provide a rifle sling that can be quickly and easily converted from a carrying sling to an aide in steadying the rifle during the act of shooting.

Another object of the invention is to provide a rifle sling that is made of a material that will not mar the finish of the firearm and that has no hardware that could damage the firearm.

Accordingly the present invention is an adjustable leather rifle sling having adjustable loops at each end. The adjustable leather rifle sling is constructed entirely from a single leather strap without the use of any hardware or auxiliary devices.

Most, if not all, rifle slings have a dedicated fore stock end and a dedicated butt stock end. The present invention does not have this limitation, so either end of the adjustable leather rifle sling may, at the shooters discretion, be used at either end of the rifle. As stated above the adjustable leather rifle sling has adjustable loops at each end. The loop at one end is formed using a twin barrel-loop slide-lock knot. In general use this loop is used to adjust the overall length of the sling and is hereafter referred to as the large adjustable loop end of the adjustable leather rifle sling. The desired length is achieved by simply sliding the slide-lock knot along the leather strap to the preferred position. At all times the slide-lock knot has sufficient pressure to hold the adjustment, however, any pressure applied to the main body of the sling causes the twin barrel-loop slide-lock knot to grip the leather strap even harder, thus locking the loop at the desired length. If the shooter so desires, additional pressure may be applied to the leather strap by simply pulling on the tag end, or tail end, of the twin barrel-loop slide-lock knot. This action causes the twin barrel-loops to elongate and constrict thereby greatly increasing their grip on the leather strap. This locking action is completely controlled by the shooter, is infinite to the breaking point of the leather strap itself, and is quickly and easily accomplished to meet the present needs of the shooter. To release the knot from it's locked position the shooter merely pushes on the tag end, or tail end, of the twin barrel-loop slide-lock knot, and the knot returns to it's normal position.

The twin barrel-loop slide-lock knot is formed by first cutting two short slits near an end of the leather strap. This action forms two pairs of short, closely joined leather bands. The end of the leather strap that the two slits are cut in is folded back under the main body of the leather strap and then passed up between the pair of leather bands farthest from said end, and then pulled forward. This action transforms the pair of leather bands into a pair of tightly spiraling barrel loops. The same end of the leather strap is then folded back over the main body of the leather strap and passed down between the pair of leather bands closest to said end, and then pulled forward. This action transforms the second pair of leather bands into a second pair of tightly spiraling barrel loops. Both sets of barrel-loops have an axis that is parallel to the long axis of the leather strap, however one set of barrel-loops are oriented in a generally downward direction and the other set is oriented in a generally upward direction.

The large adjustable loop is formed by passing the opposite end of the leather strap down between the first formed set of barrel-loops and then up between the second formed set of barrel-loops. Because one set of barrel-loops are oriented downward and the other oriented upward, bends are created in that portion of the main body of the leather strap that is within the two barrel-loops. These bends are in the general shape of the letter S. The barrel-loop knot itself coupled with the S shaped passage of the leather strap through the knot transmits pressure to all four surfaces of the leather strap. This pressure is constant and more than sufficient enough to hold the desired adjustment. Any pressure applied to the main body of the leather strap causes the S shape of the leather strap within the confines of the barrel-loop knot to straighten out a small amount. This action greatly increases the pressure on the strap, thereby preventing any slipping of the knot. Additionally, any force applied to either end of the twin barrel-loop knot that results in a stretching of the knot, such as pulling on the tag end, or tail end, of the knot, dramatically increases the pressure on the leather strap.

An adjustable loop is formed in the opposite end of the leather strap using a single set of barrel-loops. In general use this loop is normally smaller than the loop at the opposite end of the strap, and will hereafter be referred to as the small adjustable loop end of the adjustable leather rifle sling. This loop is generally not used for adjusting the length of the rifle sling when the rifle sling is attached to a firearm using conventional sling swivels, however, it can be used to adjust the length when the sling is attached directly to the gun by varying the location of attachment.

Formation of this loop begins by cutting a single slit near the end of the leather strap. This action forms a single pair of leather bands. The end of the strap is folded back under the main body of the leather strap and then passed up between the pair of leather bands, and then pulled forward. This action results in the formation of a pair of tightly spiraling barrel-loops. The opposite end of the leather strap is passed between these barrel-loops thus forming the small adjustable loop. The single barrel-loop slide-lock knot is not designed to grip the main body of the leather strap, but rather to let the leather strap pass rather freely through the knot thereby allowing the small loop to grip whatever the small loop is encircling such as sling swivels, the stock, or the barrel of a firearm. The more pressure applied to the main body of the leather strap the tighter the small loop grips the object.

An additional somewhat longer slit is cut in the large adjustable loop end of the leather strap forming two leather bands. The object of these bands is to aide in the attachment of the sling to a firearm when not using conventional sling swivels as will be shown.

By having the large adjustable loop end of the adjustable leather rifle sling attached to a forward position on the rifle the small adjustable loop end may be placed around the shooters upper arm and thereby used as an aide to steadying the rifle during the act of shooting.

Thus an adjustable leather rifle sling is formed from a single leather strap using no hardware or auxiliary devices, and meets all the objects of the invention stated above. These and other objects of the invention will become readily apparent upon further review of the following specifications and drawings.

DETAILED DESCRIPTION OF THE PREFERRED EMBODIMENT

Figure 1:
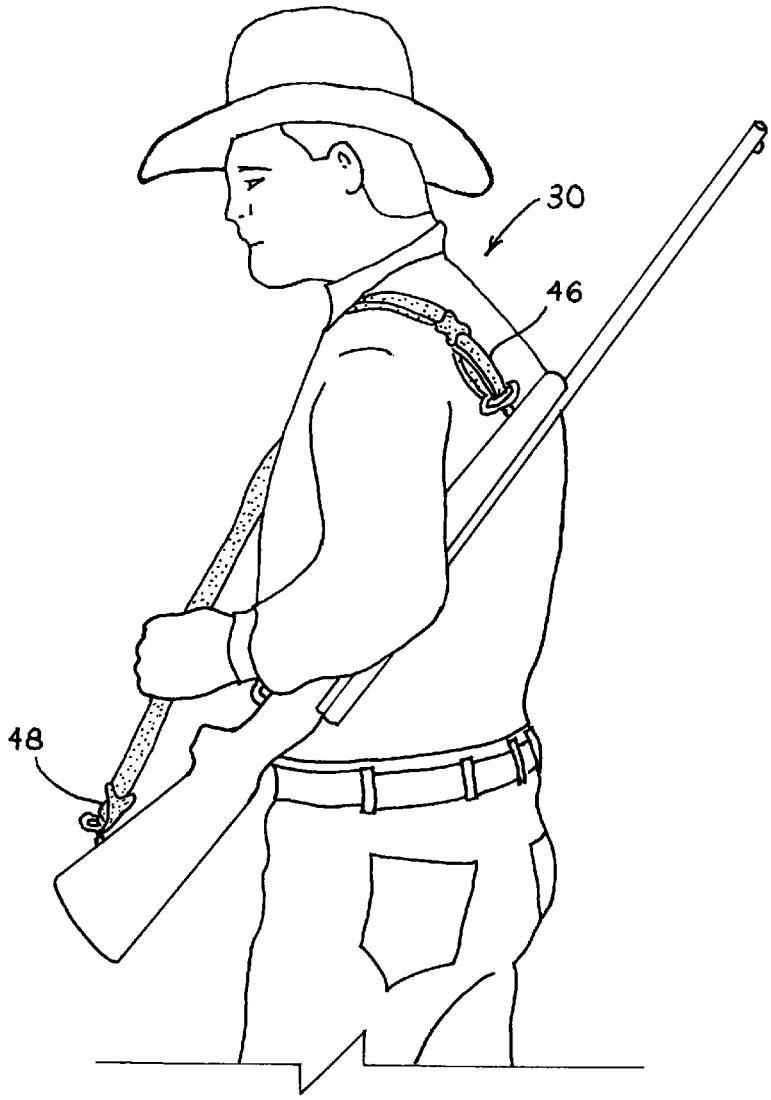
FIG. 1 is an environmental perspective view of an adjustable leather rifle sling having adjustable loops at each end.
Figure 12:
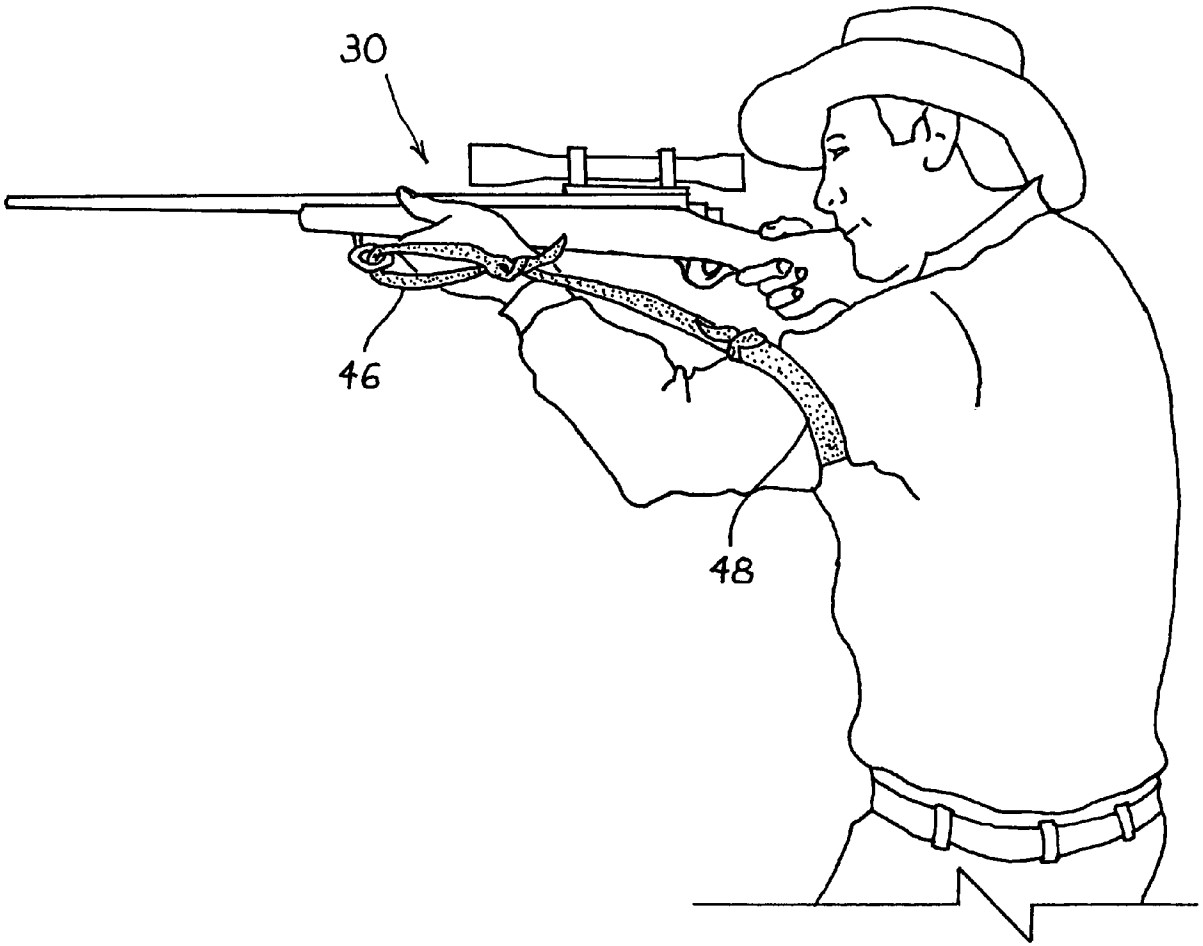
FIG. 12 is an environmental perspective view showing the adjustable leather rifle sling being used as a support during the act of shooting.

Similar numerals designate similar elements among the several figures. As shown in FIG. 1 the present invention is an adjustable leather rifle sling having adjustable loops at each end and designated generally as 30. The adjustable leather rifle sling 30 has a large adjustable loop 46 at one end and a small adjustable loop 48 at the opposite end. As shown in FIG. 1 the adjustable leather rifle sling 30 is designed as a single shoulder carrying sling, and turning to FIG. 12, we see the adjustable leather rifle sling 30 being used as a steadying device for the rifle during the act of shooting. In FIG. 12 the large adjustable loop 46 is attached to the fore stock end of the rifle by the use of conventional sling swivels however, the large adjustable loop 46 can be attached directly to the rifle by placing the large adjustable loop 46 around any desired location on the rifle. The small adjustable loop 48 is placed around the shooters upper arm and drawn tight. The large adjustable loop 46 is adjusted to the preferred length so as to obtain the desired steadying pressure on the rifle.

Most, if not all, rifle slings have a dedicated fore stock end and a dedicated butt stock end. The present invention does not have this limitation and at the shooter's discretion either end of the adjustable leather rifle sling 30 may be used at either end of the rifle. Therefore the loops at either end of the adjustable leather rifle sling 30 will be referred to as the large adjustable loop 46 end, or the small adjustable loop 48 end.

Figure 2:
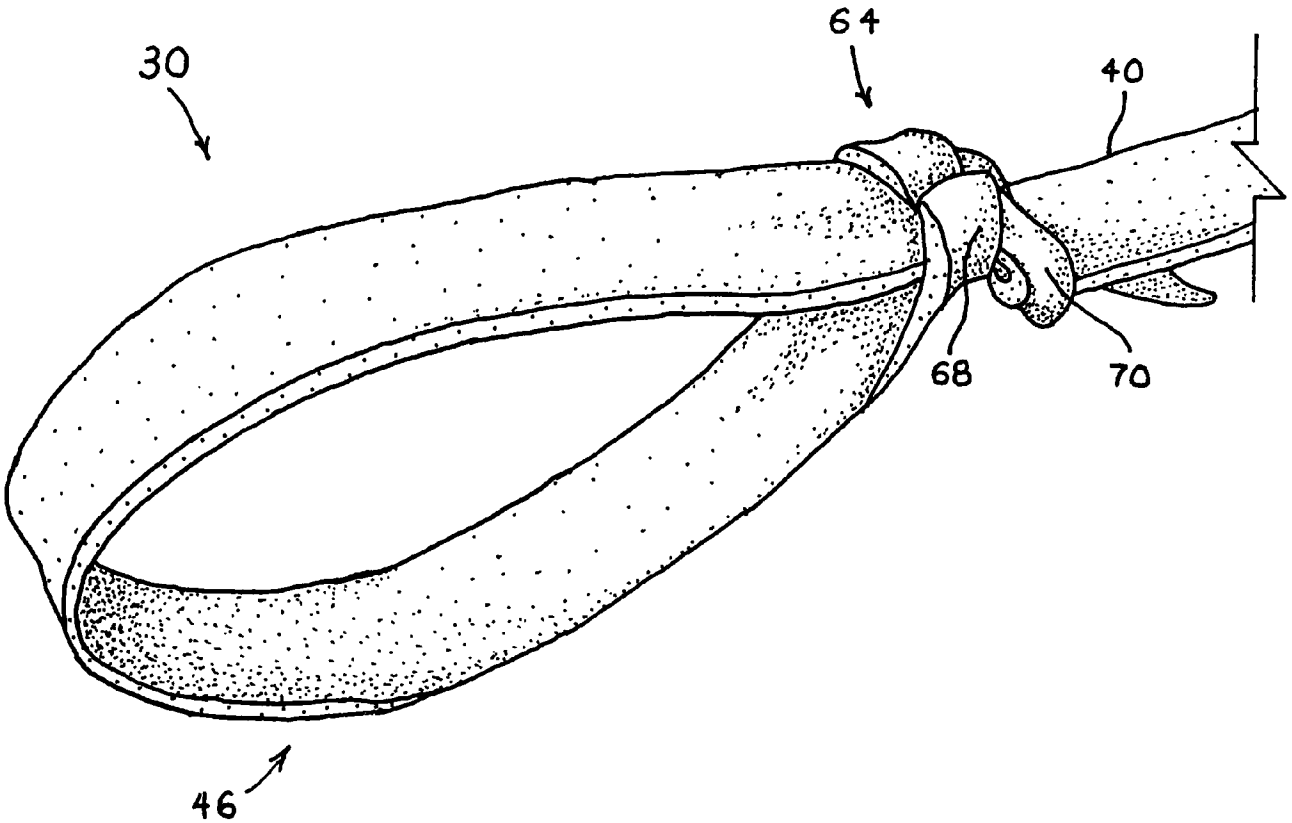
FIG. 2 is a perspective view of the large adjustable loop end of the adjustable leather rifle sling showing the twin barrel-loop slide-lock knot and the large adjustable loop.

Turning to FIG. 2 we see one end of the adjustable leather rifle sling 30 having the large adjustable loop 46 formed using the twin barrel-loop slide-lock knot 64. This twin barrel-loop slide-lock knot 64 is formed from two pairs of barrel-loops, 68 and 70. These two pairs of barrel-loops, 68 and 70, have an axis parallel to the long axis of the leather strap 40. In general use the large adjustable loop 46 is used to adjust the overall length of the adjustable leather rifle sling 30. The desired length of the adjustable leather rifle sling 30 is achieved by sliding the twin barrel-loop slide-lock knot 64 along the leather strap 40 to the desired position.

Figure 3:
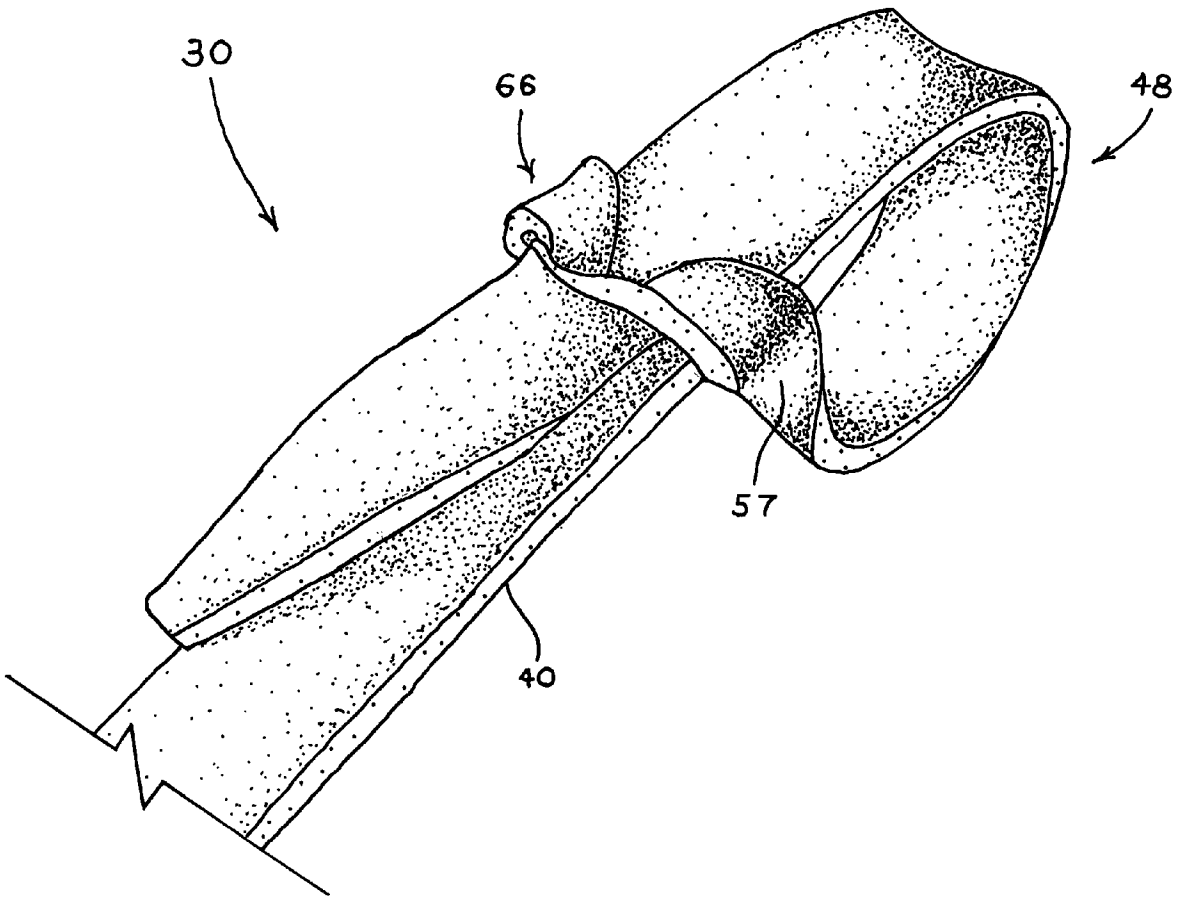
FIG. 3 is a perspective view of the small adjustable loop end of the adjustable leather rifle sling showing the single barrel-loop slide-lock knot and the small adjustable loop.

Now turning to FIG. 3 we see the small adjustable loop 48 formed in the opposite end of the adjustable leather rifle sling 30. The small adjustable loop 48 is formed using the single barrel-loop slide-lock knot 66. The single barrel-loop slide-lock knot 66 is formed from a single pair of barrel loops 57. The single pair of barrel loops 57 have an axis parallel to the long axis of the leather strap 40.

Figure 4:
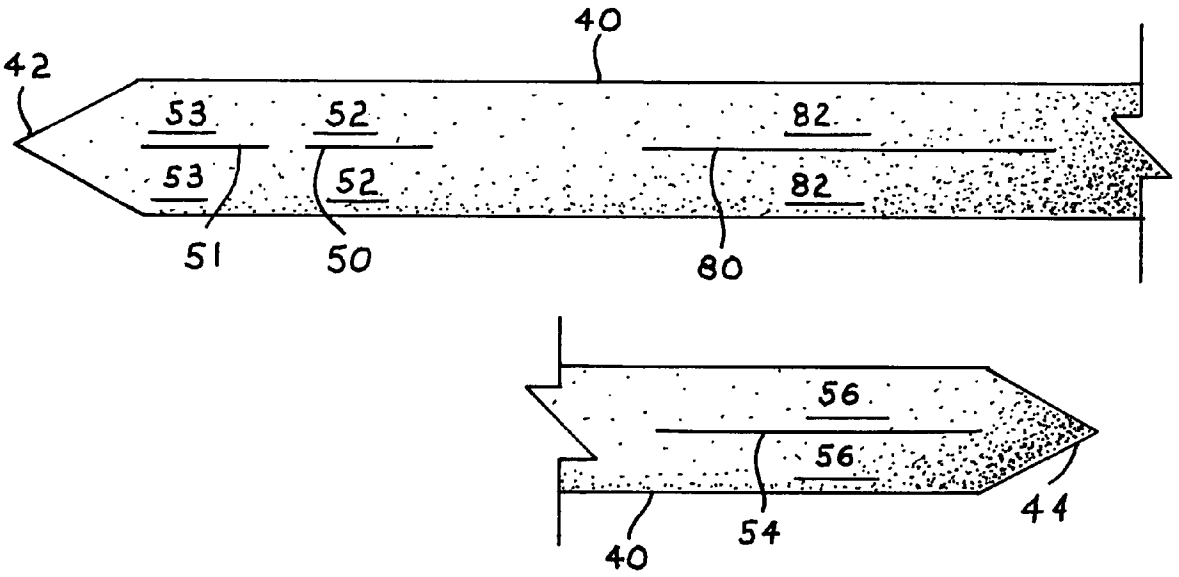
FIG. 4 is a plan view showing the lay out of the leather strap that will become an adjustable leather rifle sling. Both ends of the strap are shown.
Figure 14:
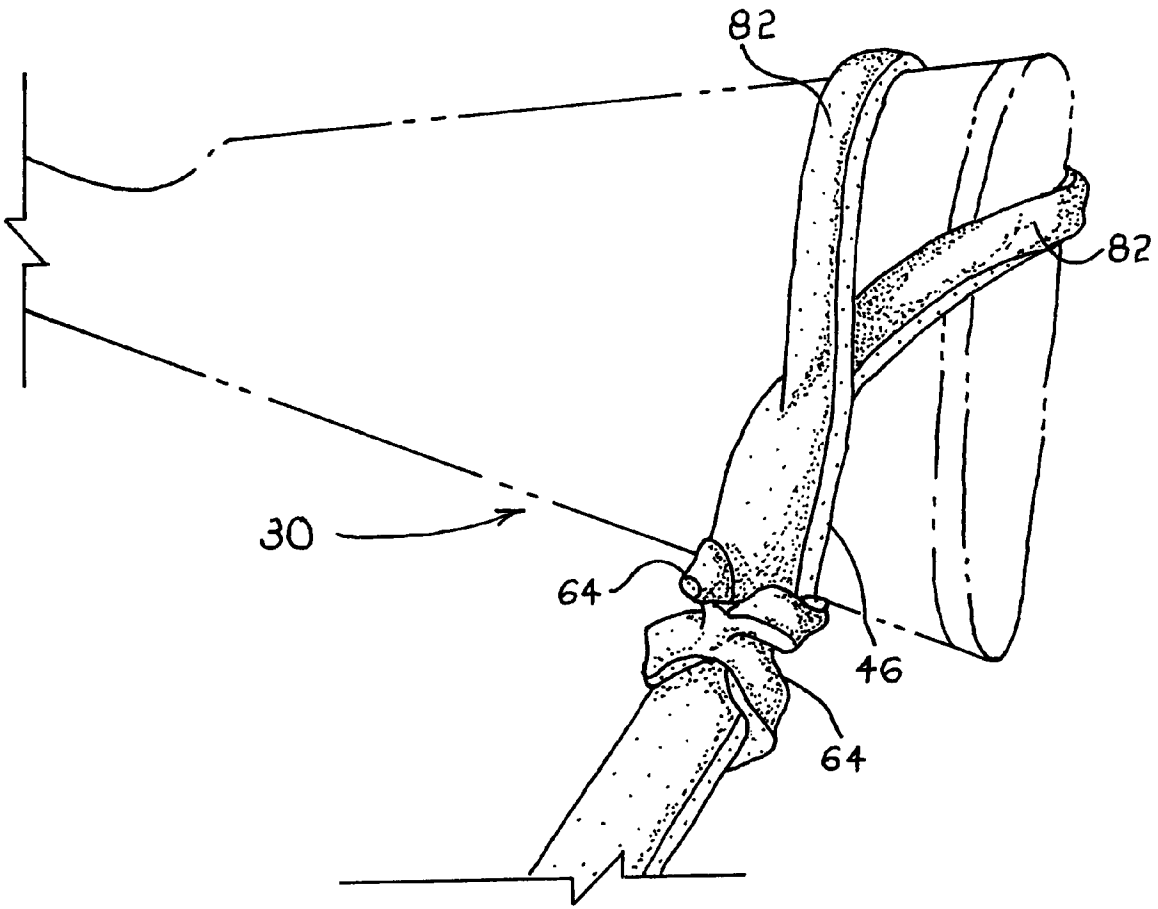
FIG. 14 is a perspective view showing the large adjustable loop end of the adjustable leather rifle sling attached directly to the butt stock end of a rifle and held in place with the twin barrel-loop slide-lock knot.

FIG. 4 discloses the lay out of the leather strap 40 prior to being assembled into the adjustable leather rifle sling 30. End 42 of the leather strap 40 is used to form the twin barrel-loop slide-lock knot 64. End 44 of the leather strap 40 is used to form the single barrel-loop slide-lock knot 66. Near end 42 of the leather strap 40 a pair of rather short slits, 50 and 51, are cut. By cutting these two slits, 50 and 51, two pairs of leather bands, 52 and 53, are formed. Leather bands 52 and 53 will be twisted to form barrel-loops 68 and 70. The slits 50 and 51, the leather bands 52 and 53, as well as the resulting barrel-loops 68 and 70, are parallel to the long axis of the leather strap 40. Also near end 42 of the leather strap 40 an additional rather long slit 80 is made. By cutting slit 80 a pair of somewhat long leather bands 82 are formed. Slit 80 and leather bands 82 are parallel to the long axis of the leather strap 40. The leather bands 82 are not used in the formation of either of the slide-lock knots 64 or 66, but are used as an aide in attaching the adjustable leather rifle sling 30 directly to the rifle without the use of conventional sling swivels as can be seen in FIG. 14. Near end 44 of the leather strap 40 a single short slit 54 is cut. By cutting the single short slit 54 a single pair of leather bands 56 are formed. The pair of leather bands 56 will be twisted to form barrel-loops 57. Slit 54, leather bands 56, and the resulting barrel loops 57, are parallel to the long axis of the leather strap 40.

Figure 5A:
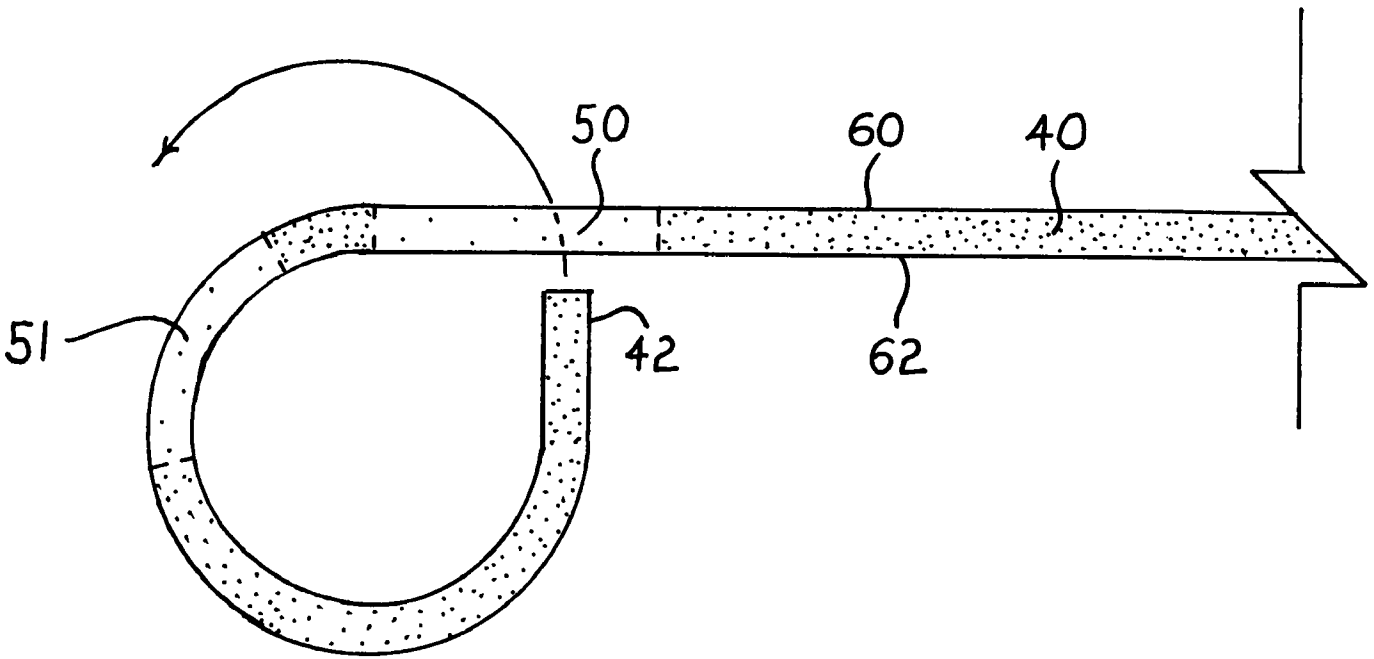
FIG. 5A is a side view showing the first step in forming the twin barrel-loop slide-lock knot.

FIG. 5A reveals the first step in forming the twin barrel-loop slide-lock knot 64 in end 42 of the leather strap 40. The leather strap 40 has a top surface 60 and a bottom surface 62. End 42 of the leather strap 40 is folded back under the bottom surface 62 of the leather strap 40. End 42 is then passed up through slit 50 and then pulled forward as indicated by the arrow. Thus the first set of barrel loops 68 are formed in the leather strap 40 as can be seen in FIG. 5B.

Figure 5B:
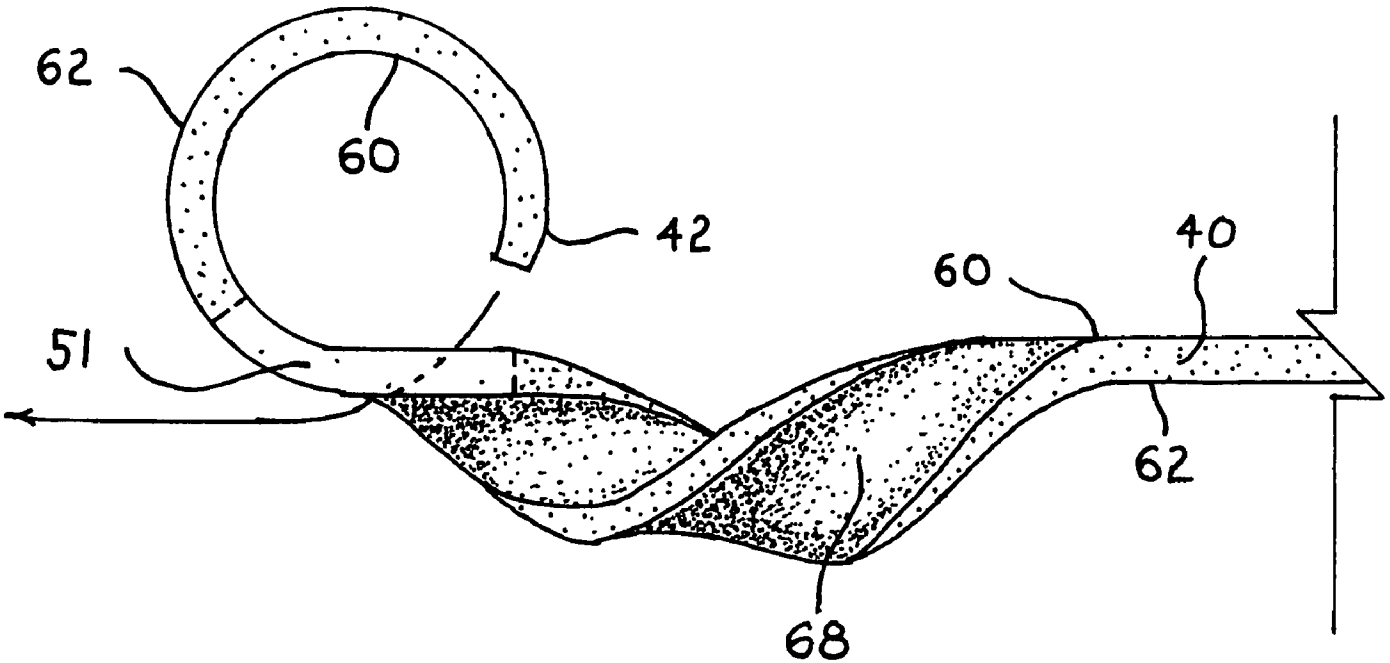
FIG. 5B is a side view showing the first barrel-loop formed and the second loop being formed.

FIG. 5B also discloses the next step in forming the twin barrel-loop slide-lock knot 64. End 42 of the leather strap 40 is folded back over the top surface 60 of leather strap 40 and passed down through slit 51 and again pulled forward as indicated by the arrow. Thus the second set of barrel loops 70 are formed as seen in FIG. 5C.

Figure 5C:
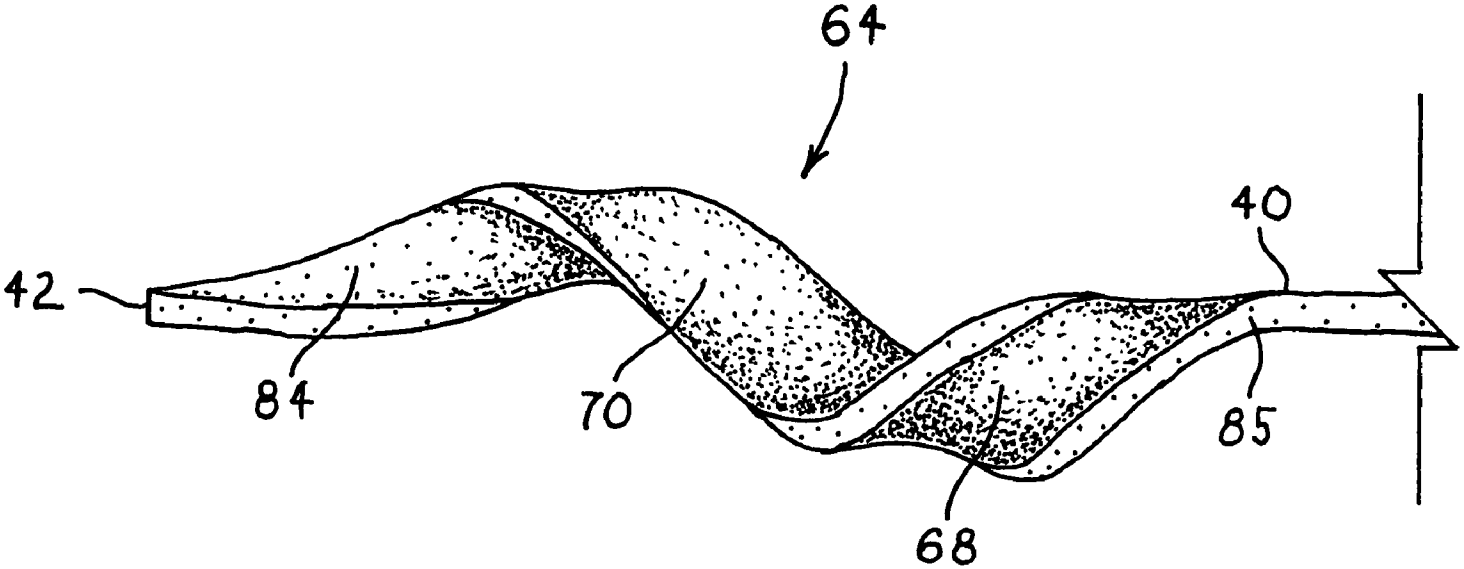
FIG. 5C is a side view showing both barrel-loops formed.

In addition FIG. 5C discloses that the two barrel-loops 68 and 70 combine to form the twin barrel-loop slide-lock knot 64. This figure also shows that the twin barrel-loop slide-lock knot 64 has a tag end 84 and a tail end 85.

Figure 5D:
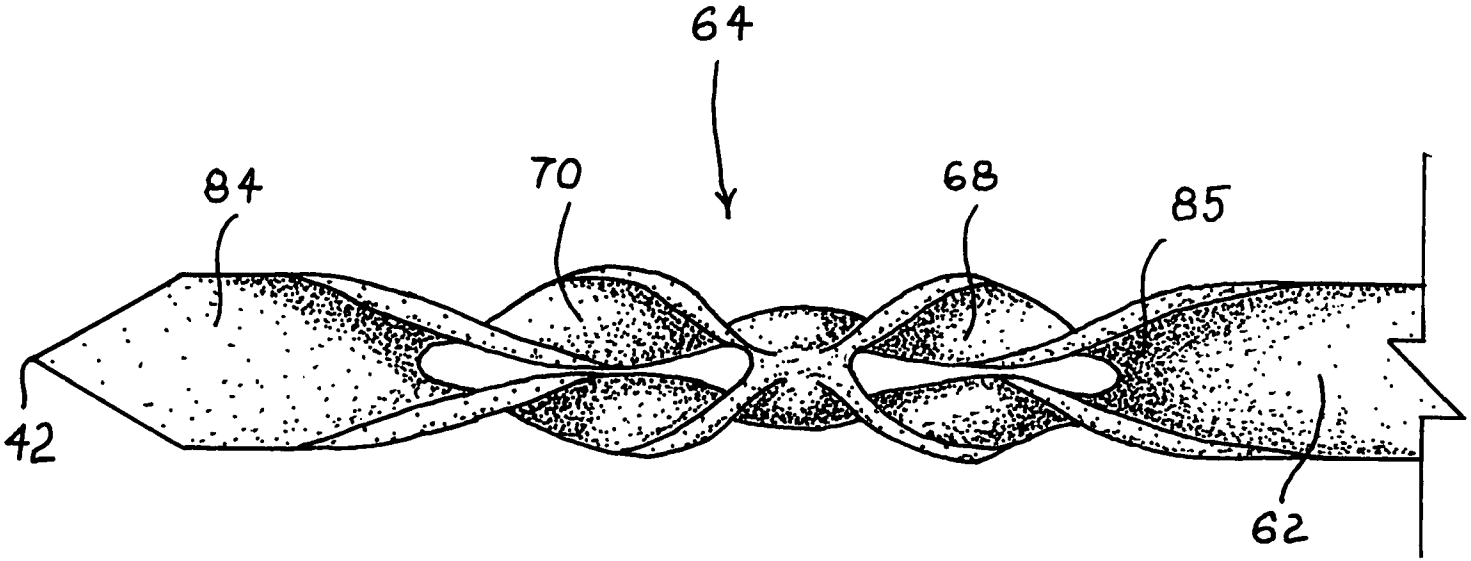
FIG. 5D is a top view showing the twin barrel-loops formed.

In FIG. 5D we have a bottom view of end 42 of the leather strap 40 showing the two barrel-loops 68 and 70 formed.

Figure 5E:
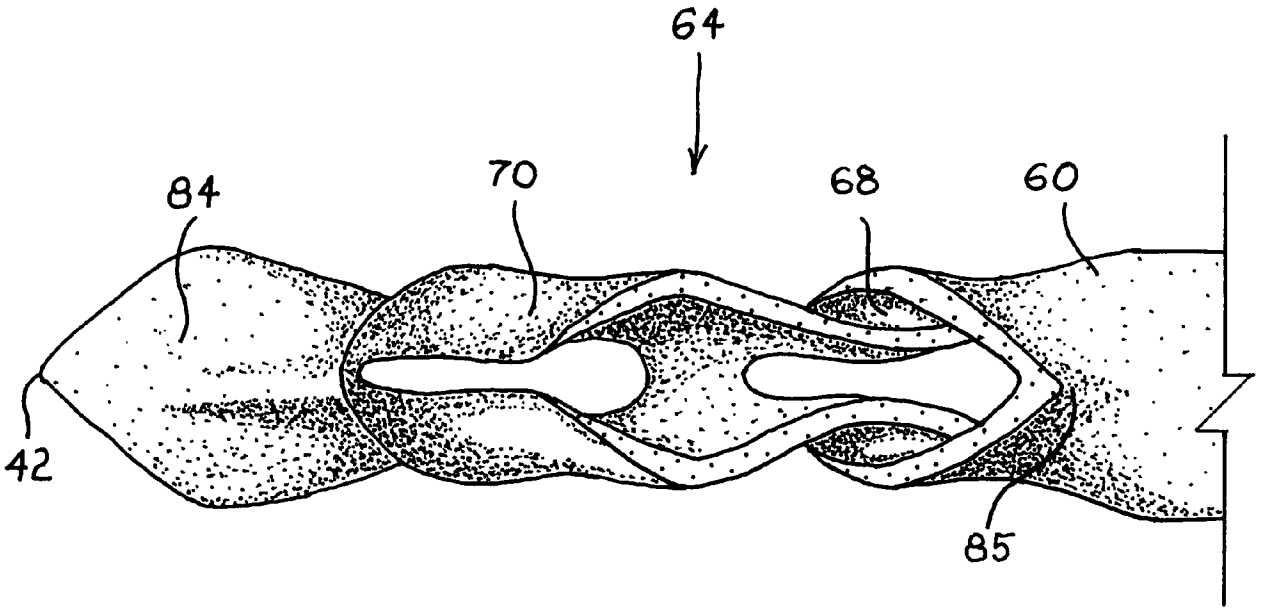
FIG. 5E is a bottom view showing the twin barrel-loops formed.

In FIG. 5E we have a top view of end 42 of the leather strap 40 showing the two barrel loops 68 and 70 formed.

Figure 6:
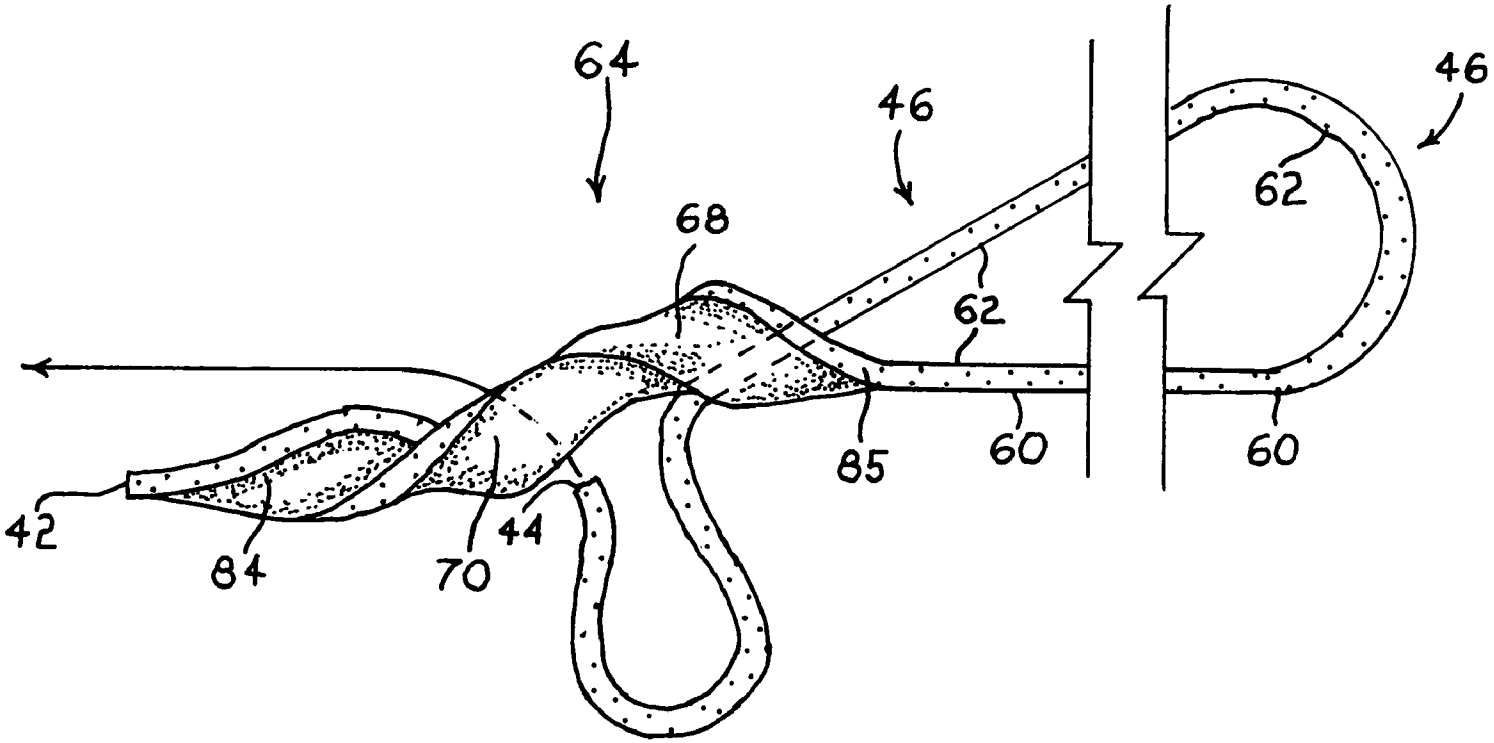
FIG. 6 is a side view showing how to form the large adjustable loop using the twin barrel-loop knot.

FIG. 6 is a side view showing how the twin barrel-loop slide-lock knot 64 is utilized to form the large adjustable loop 46. Formation of the large adjustable loop 46 begins by placing end 42 of the leather strap 40 with the bottom surface 62 of the leather strap 40 facing up. The opposite end 44 of the leather strap 40 is folded back over the bottom surface 62 of the leather strap 40 and passed down between the set of barrel loops 68 as shown in FIG. 6. End 44 of leather strap 40 is then passed up between the set of barrel loops 70 and pulled in the direction of end 42 as seen by the arrow. Thus the large adjustable loop 46 is formed in end 42 of the leather strap 40 using the twin barrel-loop slide-lock knot 64.

Figure 7A:
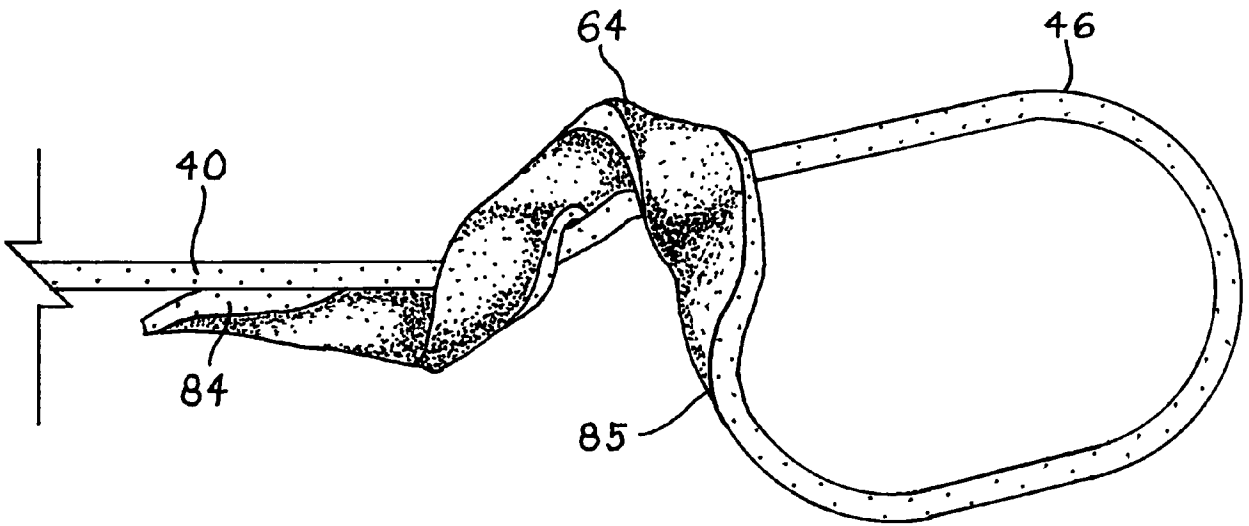
FIG. 7A is a side view showing the large adjustable loop formed and the slide-lock knot in it's normal self-locking position.

FIG. 7A is a side view of the twin barrel-loop slide-lock knot 64 and showing the large adjustable loop 46 formed. As noted above and seen in this figure one set of barrel loops of the slide-lock knot 64 are oriented in a generally downward direction and the other in a generally upward direction, thus curves are formed in that portion of the leather strap 40 that is within the twin barrel-loop slide-lock knot 64. These curves are in the general shape of the letter S. The twin barrel-loop slide-lock knot 64 coupled with the S shaped passage of the leather strap 40 through the twin barrel-loop slide-lock knot 64 creates sufficient pressure on all four sides of the leather strap 40 to hold the large adjustable loop 46 at any desired length. In FIG. 7A the twin barrel-loop slide-lock knot 64 is in it's normal use, self locking position. Any pressure applied to the main body of the adjustable leather rifle sling 30 causes the S shaped bends of the leather strap 40 that are within the twin barrel-loop slide-lock knot 64 to straighten a slight amount, thereby creating more resistance and thus preventing any slipping of the twin barrel-loop slide-lock knot slide-lock knot 64.

Figure 7B:
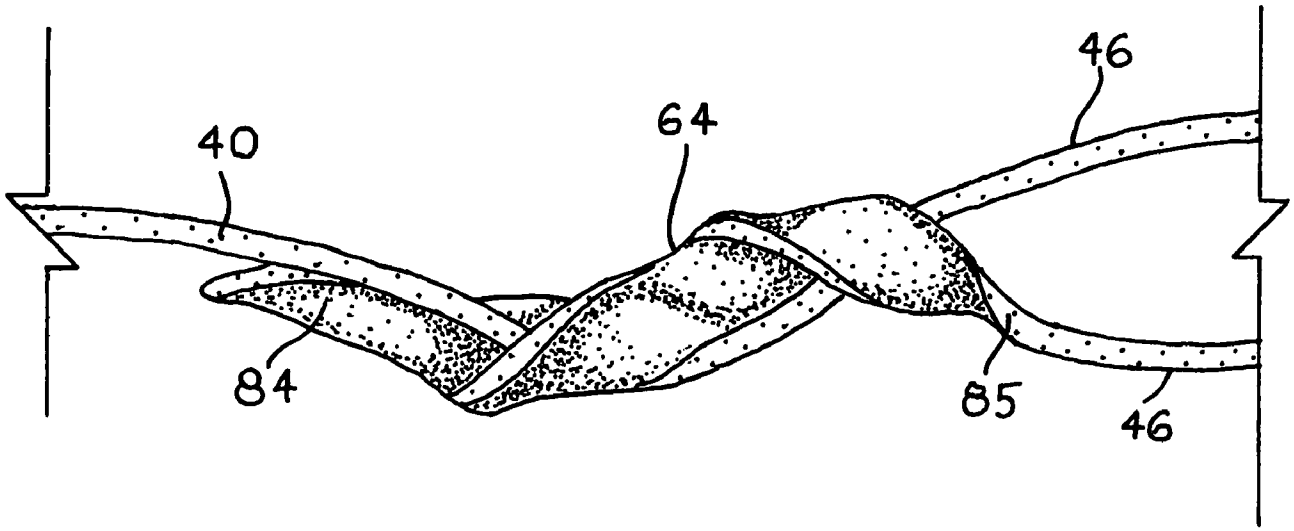
FIG. 7B is a side view showing the slide-lock knot in it's stretched, manually locked position.

As noted above the twin barrel-loop slide-lock knot 64 is self-locking, however when the shooter so desires the twin barrel-loop slide-lock knot 64 can be manually locked as shown in FIG. 7B. By merely pulling on the tag end 84, or the tail end 85, of the twin barrel-loop slide-lock knot 64, the knot is stretched, thereby causing the two sets of barrel loops 68 and 70 to constrict, and the leather strap 40 to straighten a slight amount, this action resulting in an increase of pressure on the leather strap 40. The amount of pressure applied by the twin barrel-loop slide-lock knot 64 to the leather strap 40 is completely controlled by the shooter, and is infinite to the breaking point of the leather strap 40 itself. Regardless of how much or how little pressure the twin barrel-loop slide-lock knot 64 is subjected to, the pressure can be quickly, simply, and easily released by merely pushing on either the tag end 84, or the tail end 85, of the twin barrel-loop slide-lock knot 64. This simple pushing action returns the twin barrel-loop slide-lock knot 64 to it's normal use, self-locking position.

Figure 8A:
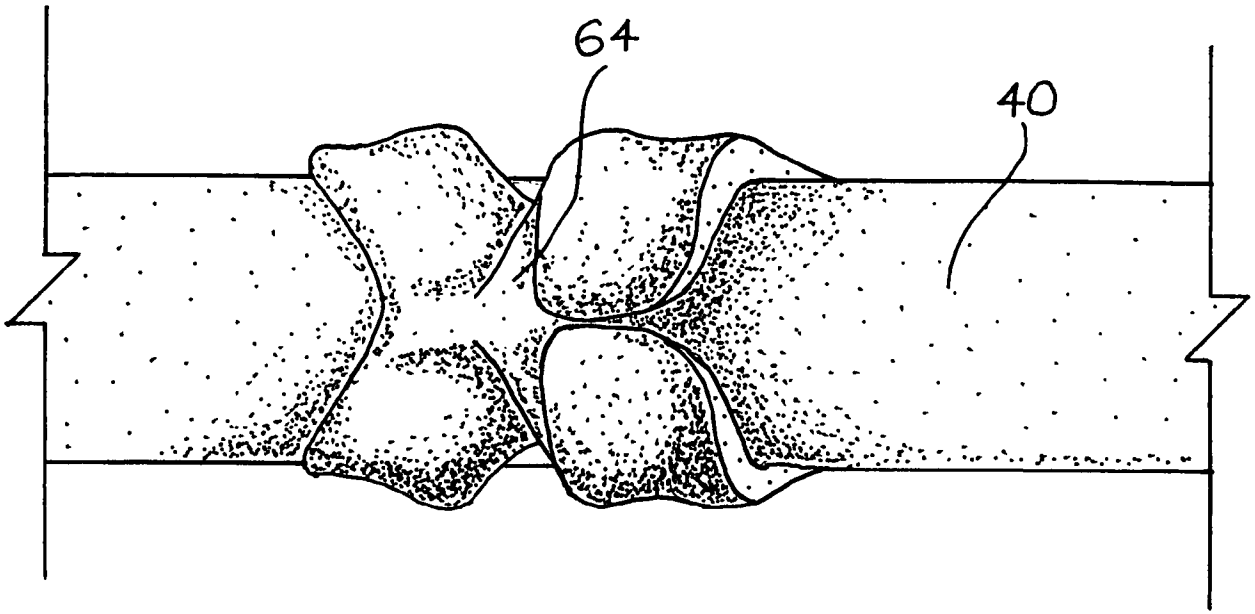
FIG. 8A is a top view showing the slide-lock knot in it's normal use self-locking position.
Figure 8B:
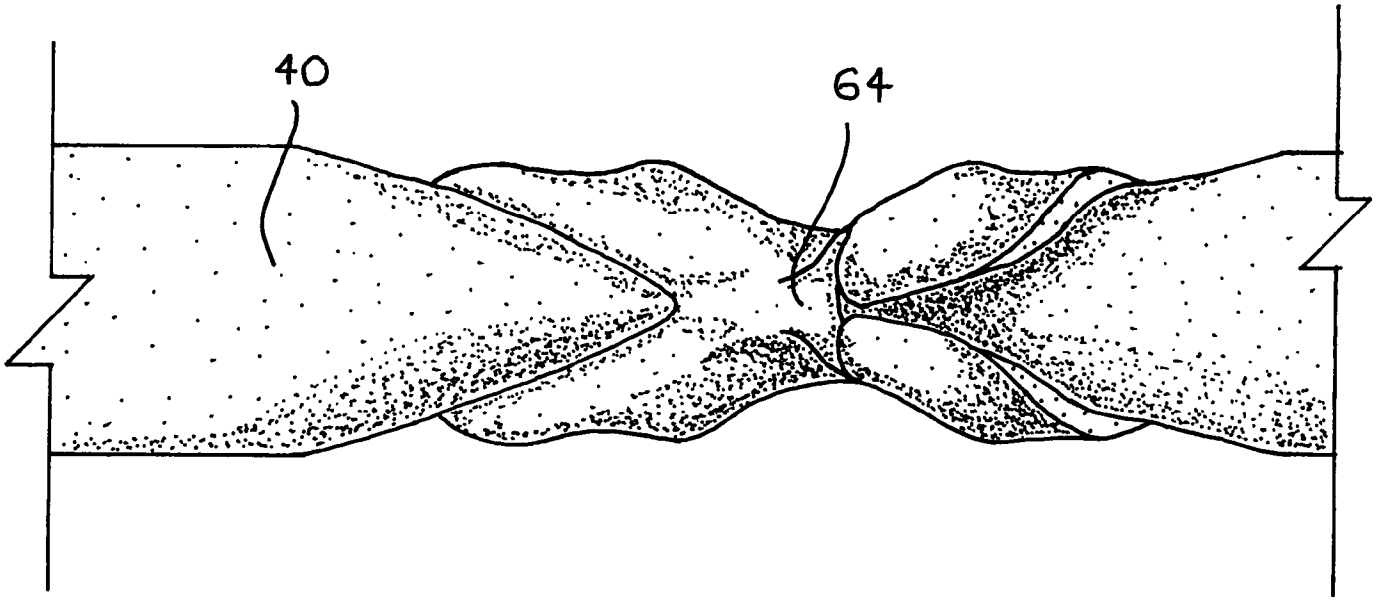
FIG. 8B is a top view showing the slide-lock knot in it's stretched, manually locked position.

FIG. 8A is a top view showing the twin barrel-loop slide-lock knot 64 is it's normal use, self-locking position. While FIG. 8B is a top view showing the twin barrel-loop slide-lock knot 64 in it's stretched, manually locked position.

Figure 9A:
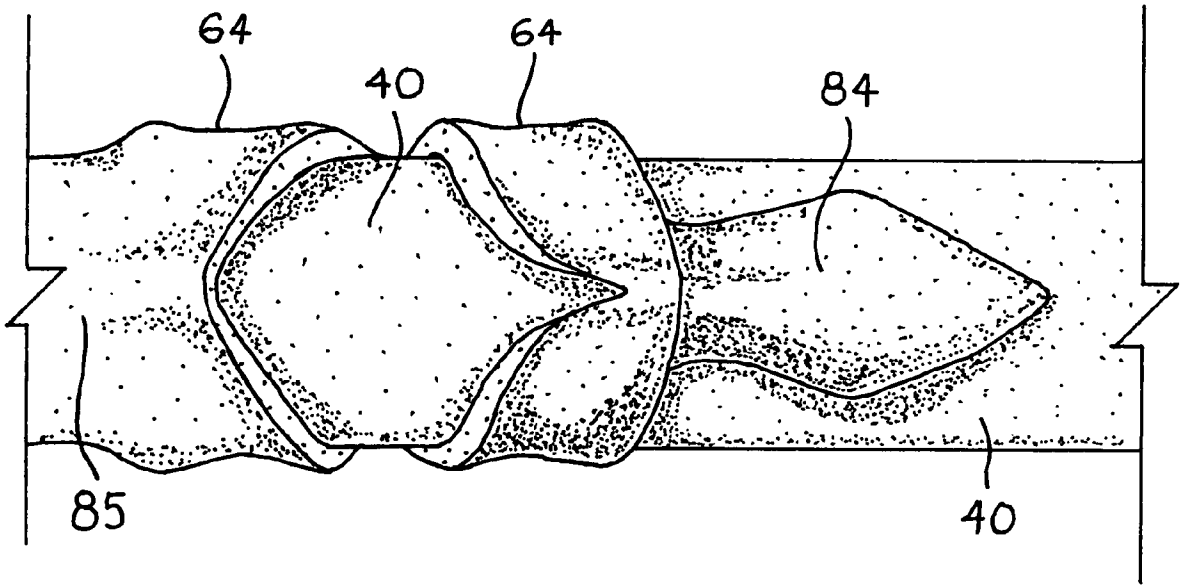
FIG. 9A is a bottom view showing the slide-lock knot in it's normal self-locking position.
Figure 9B:
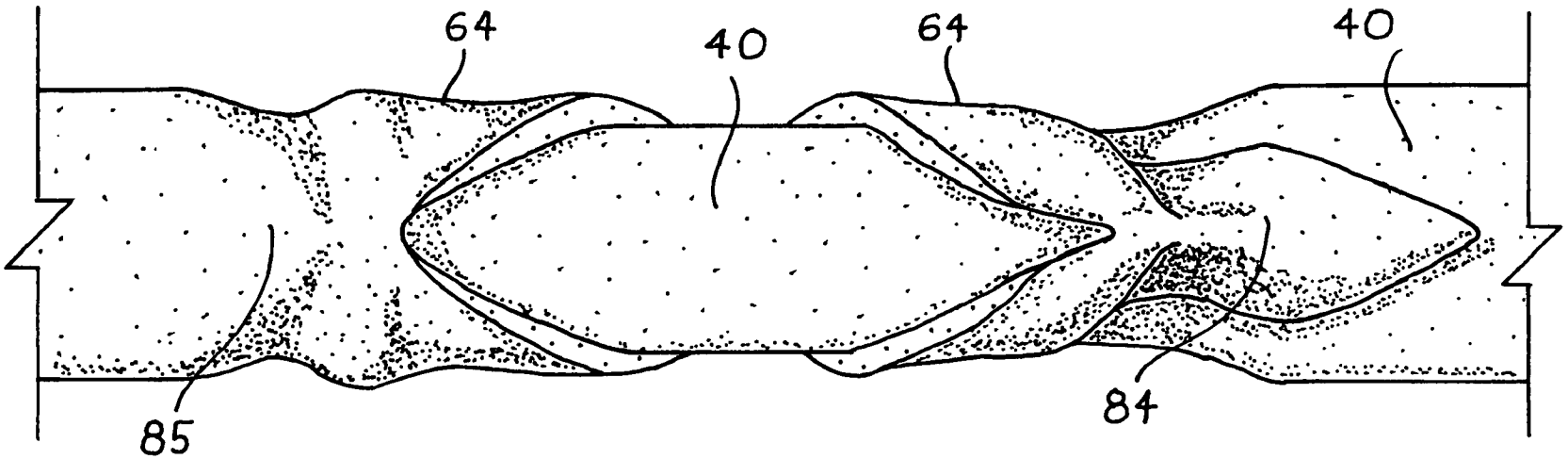
FIG. 9B is a bottom view showing the slide-lock knot in it's stretched, manually locked position.

FIG. 9A is a bottom view showing the twin barrel-loop slide-lock knot 64 in it's normal use, self-locking position. FIG. 9B is a bottom view showing the twin barrel-loop slide-lock knot 64 in it's stretched, manually locked position.

Figure 10A:
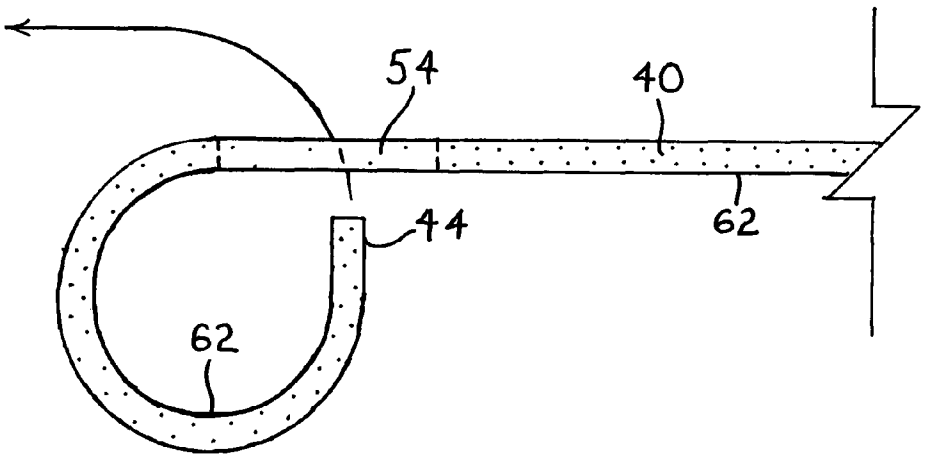
FIG. 10A is a side view showing the single barrel-loop knot being formed.
Figure 10B:
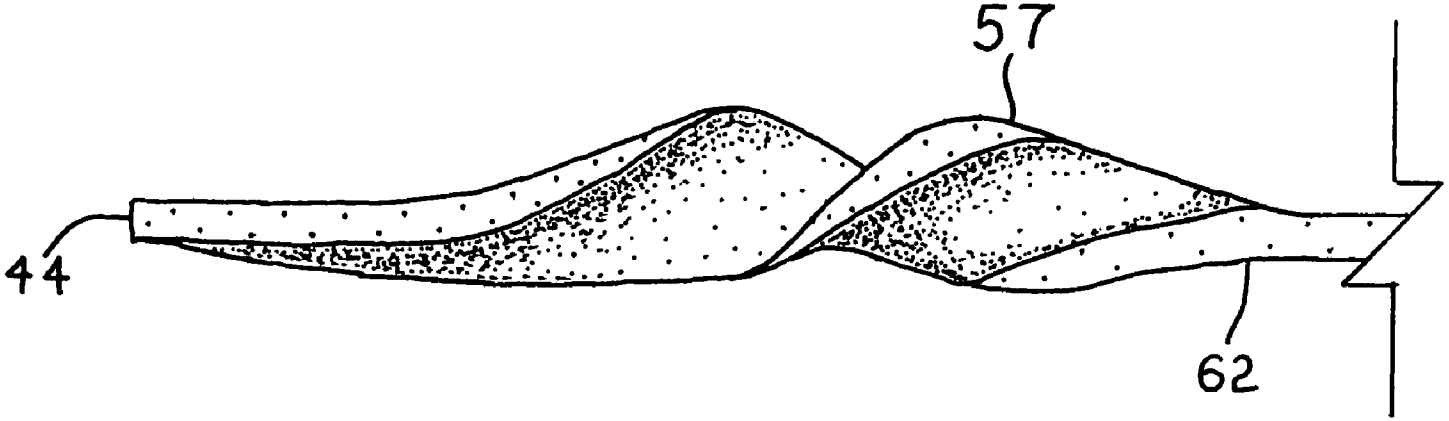
FIG. 10B is a side view showing the single barrel-loop knot formed.

Turning to FIG. 10A a side view of end 44 of the leather strap 40 is presented. With the bottom surface 62 of the leather strap 40 facing down, end 44 of the leather strap 40 is folded back under the bottom surface 62 of the leather strap 40 and then passed up through slit 54, and pulled forward as indicated by the arrow. This action forms the single set of barrel loops 57 as seen in FIG. 10B. The single set of barrel loops 57 form the single barrel-loop slide lock knot 66 as seen in FIG. 11.

Figure 11:
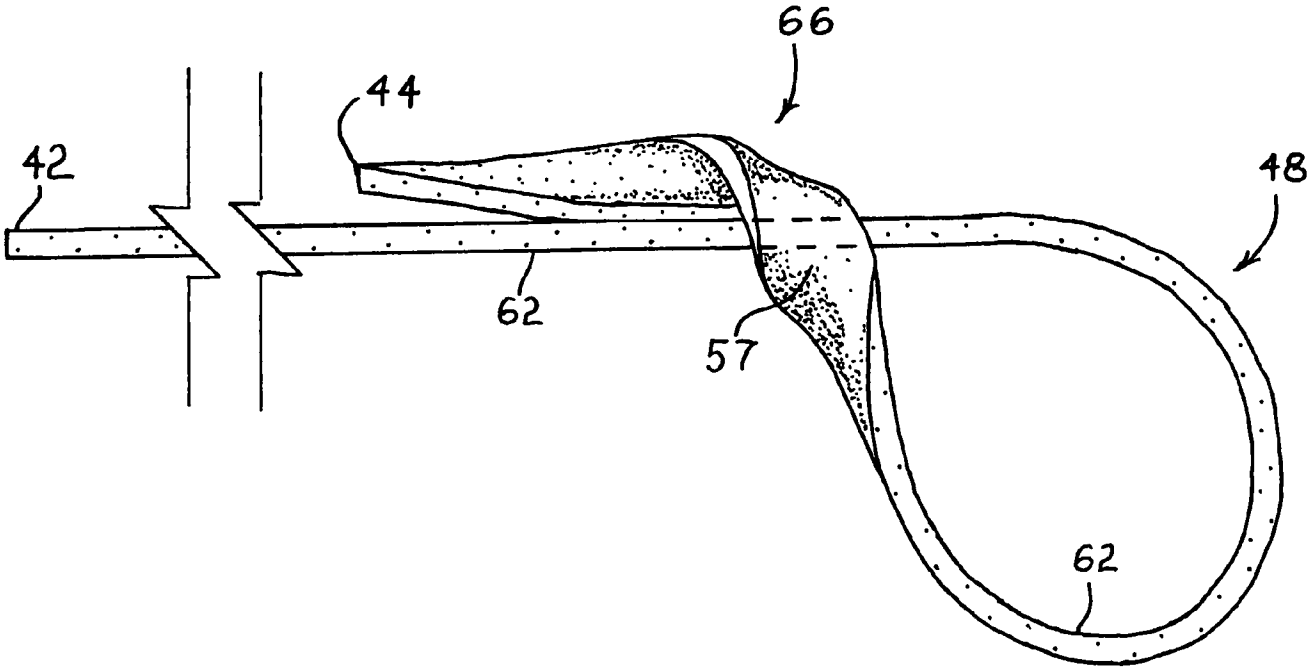
FIG. 11 is a side view showing the small adjustable loop formed using the single barrel-loop knot

In FIG. 11 the small adjustable loop 48 is shown utilizing the single barrel-loop slide-lock knot 66. The small adjustable loop 48 is formed by having the bottom surface 62 of the leather strap 40 facing up. In this figure end 44 of the leather strap 40 is facing to the left, and the single barrel-loop slide-lock knot 66 is formed. End 42 of the leather strap 40 is folded back over the top of the bottom surface 62, of the leather strap 40, and then passed between the barrel loops 57 of the slide-lock knot 66. Thus the small adjustable loop 48 is formed in end 44 of the leather strap 40.

Thus an adjustable leather rifle sling 30 is formed from a single leather strap 40, without the use of any hardware such as buckles, clasps, clamps, slides, rivets, screws or other devices.

FIG. 12 is an environmental perspective view showing the adjustable leather rifle sling 30 being used as an aide in steadying the rifle during the act of shooting. The large adjustable loop 46 in this figure is attached to a conventional sling swivel mounted on the fore stock of the rifle. The small adjustable loop 48 is placed around the upper arm of the shooter, thereby steadying the rifle.

Figure 13:
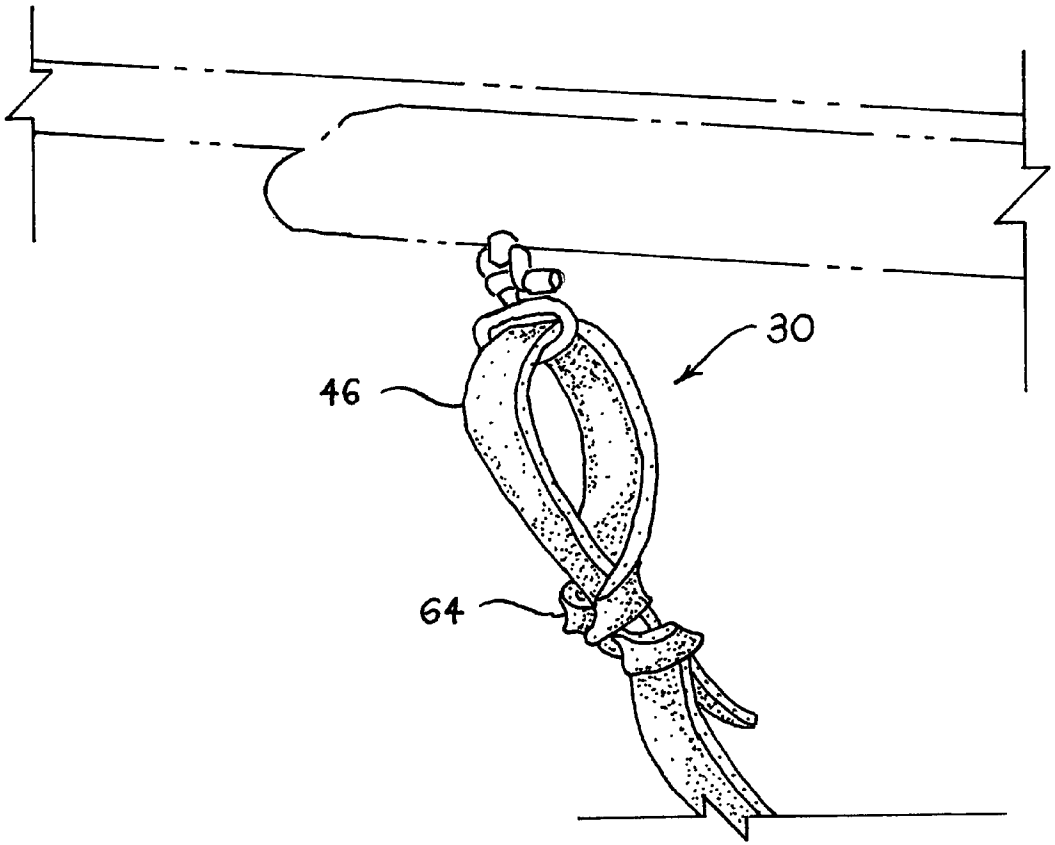
FIG. 13 is a perspective view showing an end of the adjustable leather rifle sling attached to a rifle using conventional sling swivels.

FIG. 13 is a perspective view showing the large adjustable loop 46 attached to a conventional sling swivel mounted on the fore stock of a rifle, and the large adjustable loop 46 held in place by the twin barrel-loop slide-lock knot 64.

In FIG. 14 we have a perspective view of the large adjustable loop 46 placed around the butt stock of a rifle. In this view bands 82 are crossed one over the other and placed over the heel of the rifle's butt stock, the large adjustable loop 46 is then drawn tight and locked in place with the twin barrel-loop slide-lock knot 64. However the large adjustable loop 46 can be placed around the rifle at any desired location on either end of the rifle and secured in place with the twin barrel-loop slide-lock knot 64.

Figure 15:
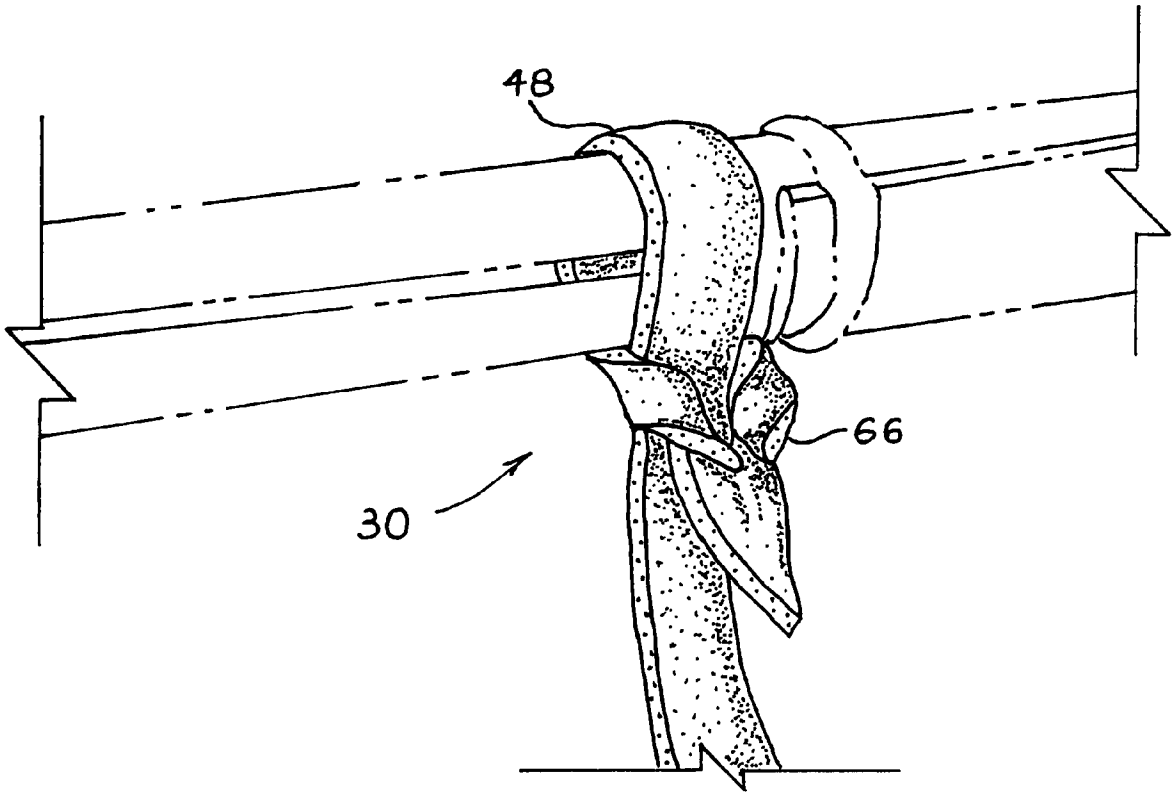
FIG. 15 is a perspective view showing the small adjustable loop end of the adjustable leather rifle sling attached directly to the barrel end of a rifle and held in place with the single barrel-loop slide-lock knot.

And in FIG. 15 we have a perspective view of the small adjustable loop 48 placed around the barrel of a rifle and secured in place with the single barrel-loop slide-lock knot 66. The small adjustable loop 48 can also be attached at any point on the rifle that the shooter desires and secured in place with the single barrel-loop slide-lock knot 66.

The foregoing is considered as illustrative only of the preferred embodiment Since modifications and changes may occur it is not desired to limit the invention to the exact construction and operation shown and described, and accordingly all suitable modifications and equivalents may be regarded as falling within the scope of the invention as defined by the claims that follow.

I claim:

1. An adjustable leather rifle sling, comprising;

a leather strap having a longitudinal axis and first and second ends;

a plurality of first spiraled bands formed in said leather strap, said spiraled bands being near said first end, said first spiraled bands being parallel to said longitudinal axis of said leather strap;

said first spiraled bands being formed in pairs, and said pairs of spiraled bands arranged along said longitudinal axis of said leather strap;

wherein said pairs of first spiraled bands form a slide lock knot;

wherein said slide lock knot is tension adjustable by applying longitudinal pressure to either end of said slide lock knot;

said second end of said leather strap being passed through said pairs of first spiraled bands of said slide lock knot forming a large loop in said leather strap;

wherein said large loop is adjusted by sliding said first spiraled bands of said slide lock knot along the length of said leather strap.

2. The adjustable leather rifle sling according to claim 1, further comprising;

a pair of second spiraled bands formed in said leather strap, said spiraled bands being near said second end, said second spiraled bands being parallel to said longitudinal axis of said leather strap;

said first end of said leather strap being passed through said pair of second spiraled bands forming a small loop in said leather strap;

wherein said small loop is adjusted by sliding said second spiraled bands along the length of said leather strap.

3. The adjustable leather rifle sling according to claim 1, wherein said adjustable leather rifle sling is formed from said leather strap without the use of any auxiliary devices.

* * * * *